US011241634B2

(12) United States Patent
Lawber

(10) Patent No.: US 11,241,634 B2
(45) Date of Patent: Feb. 8, 2022

(54) FIGURINE WITH MAGNETIC ASSEMBLY COMPONENTS

(71) Applicant: Jeff Lawber, Portland, OR (US)

(72) Inventor: Jeff Lawber, Portland, OR (US)

( * ) Notice: Subject to any disclaimer, the term of this patent is extended or adjusted under 35 U.S.C. 154(b) by 0 days.

(21) Appl. No.: 16/354,088

(22) Filed: Mar. 14, 2019

(65) Prior Publication Data

US 2019/0282913 A1 Sep. 19, 2019

Related U.S. Application Data

(60) Provisional application No. 62/643,021, filed on Mar. 14, 2018.

(51) Int. Cl.
*A63H 3/16* (2006.01)
*A63H 33/26* (2006.01)
*A63H 3/46* (2006.01)

(52) U.S. Cl.
CPC ..... *A63H 3/16* (2013.01); *A63H 3/46* (2013.01); *A63H 33/26* (2013.01)

(58) Field of Classification Search
CPC ..... A63H 3/16; A63H 3/20; A63H 3/46
USPC ..... 446/92, 97, 99, 376
See application file for complete search history.

(56) References Cited

U.S. PATENT DOCUMENTS 2,752,726 A * 7/1956 Calverley ..... A63H 3/16 446/99
2,767,517 A * 10/1956 Hooper ..... A63H 33/26 446/139
2,966,762 A * 1/1961 Hardaway ..... A63H 3/46 446/138
3,068,615 A * 12/1962 Nassour ..... A63J 25/00 446/139
3,375,604 A * 4/1968 Alonso ..... A63H 3/16 446/92
3,510,979 A * 5/1970 Fischer ..... A63H 33/105 446/102
3,685,284 A * 8/1972 Taubner, Jr. ..... A44C 11/002 59/80
3,883,984 A * 5/1975 Champeaux ..... A63H 3/16 446/92
4,038,775 A * 8/1977 Sato ..... A63H 3/46 446/92
4,118,888 A * 10/1978 Ogawa ..... A63H 3/16 124/16
5,277,643 A * 1/1994 Ejima ..... A63H 33/003 446/139
5,295,889 A * 3/1994 Ejima ..... A63H 3/28 446/130
6,705,794 B2 * 3/2004 Varner ..... A47F 8/00 223/66

(Continued)

*Primary Examiner* — Joseph B Baldori
(74) *Attorney, Agent, or Firm* — Stoel Rives LLP

(57) ABSTRACT

The disclosure relates to a figurine having magnetically attachable components and accessories that can be assembled and manipulated in various configurations to alter the appearance of the figurine as desired. The figurine includes a core having a plurality of magnetic joints coupled along various surfaces of the core. Each of the components of the figurine (such as the head, hands, and feet) includes a complementary magnetic joint designed to magnetically interact with the magnetic joints on the core to couple the components to the core, and to accommodate movement of the components relative to the core.

19 Claims, 17 Drawing Sheets

(56) References Cited

U.S. PATENT DOCUMENTS

| | | | | |
|---|---|---|---|---|
| 6,893,315 | B2 * | 5/2005 | Barri | A63H 3/46 446/376 |
| 9,384,880 | B2 * | 7/2016 | van Ninhuijs | H01F 7/0231 |
| 9,539,520 | B2 * | 1/2017 | Rotbard | A63H 33/042 |
| 9,821,244 | B1 * | 11/2017 | Whang | A63H 33/046 |
| 10,232,276 | B2 * | 3/2019 | Hacking | A63H 3/46 |
| 2005/0118926 | A1 * | 6/2005 | Roger | A63H 33/046 446/137 |
| 2006/0178081 | A1 * | 8/2006 | Daftari | A63H 33/26 446/92 |
| 2015/0283475 | A1 * | 10/2015 | Hiller | A63H 33/046 446/92 |
| 2020/0316485 | A1 * | 10/2020 | Haughey | A63H 17/264 |

* cited by examiner

FIGURINE WITH MAGNETIC ASSEMBLY COMPONENTS

RELATED APPLICATIONS DATA

This application is a nonprovisional of and claims the benefit under 35 U.S.C. § 119(e) of U.S. Provisional Patent Application No. 62/643,021 filed Mar. 14, 2018, the disclosure of which is incorporated by reference herein in its entirety.

BACKGROUND

The field of the present disclosure relates generally to toys and figurines, and in particular, to such figurines having magnetically attachable components and accessories that can be assembled and manipulated in various configurations to alter the appearance of the figurine as desired.

Figurines have long been popular toys in modern society for both children and adults. Over the last few decades, figurines have evolved from static reproductions of animals, athletes, cartoon characters, or the like, into more dynamic figurines with articulating joints and a range of interchangeable accessories or features that can be incorporated into the figurine. Some more advanced figurines are responsive to real-world stimuli, such as sound and touch, and may be programmable to communicate with a user.

The present inventor has determined that it would be desirable to develop a figurine with multiple, interchangeable components that are customizable to allow a user to create a unique figurine. The present inventor has further determined that it would be desirable to develop such a figurine that can be painted, colored, or otherwise personalized to suit the user's desires. Additional aspects and advantages will be apparent from the following detailed description of example embodiments, which proceeds with reference to the accompanying drawings. It should be understood that the drawings depict only certain example embodiments and are not to be considered as limiting in nature.

DETAILED DESCRIPTION OF EXAMPLE EMBODIMENTS

With reference to the drawings, this section describes particular embodiments and their detailed construction and operation. The embodiments described herein are set forth by way of illustration only and not limitation. The described features, structures, characteristics, and methods of operation may be combined in any suitable manner in one or more embodiments. In view of the disclosure herein, those skilled in the art will recognize that the various embodiments can be practiced without one or more of the specific details or with other methods, components, materials, or the like. In other instances, well-known structures, materials, or methods of operation are not shown or not described in detail to avoid obscuring more pertinent aspects of the embodiments.

With reference to the figures, the following disclosure relates generally to a figurine having a number of highly customizable components, such as hands, legs, heads, and various additional accessories, such as hats, helmets, lassos, candles, swords, broomsticks, or any other suitable accessories that are attachable to the figurine to create a unique design. In some embodiments, the components may be magnetically attachable to a core component to facilitate coupling and decoupling of components, as well as rotation and movement of those components, as desired. In other embodiments, some or all of the components may be manufactured from a material that may be easily painted and decorated as desired to further customize the figurine. For example, in one embodiment, the components may be made from a resin, vinyl, plastic, or other suitable material that can be painted to create an aesthetically pleasing figurine.

In some embodiments, the figurine may have a generally humanoid shape with components representing a head, torso, hands, and legs. It should be understood that this configuration is merely one example embodiment for illustration purposes and the disclosure is not intended to be limited to that specific embodiment. In other embodiments, the figurine may take any desirable form, such as pets/animals, vehicles, buildings, or any other suitable animate or inanimate object. Additional details of these and other embodiments are further discussed below with particular reference to the accompanying figures.

Figure 1:
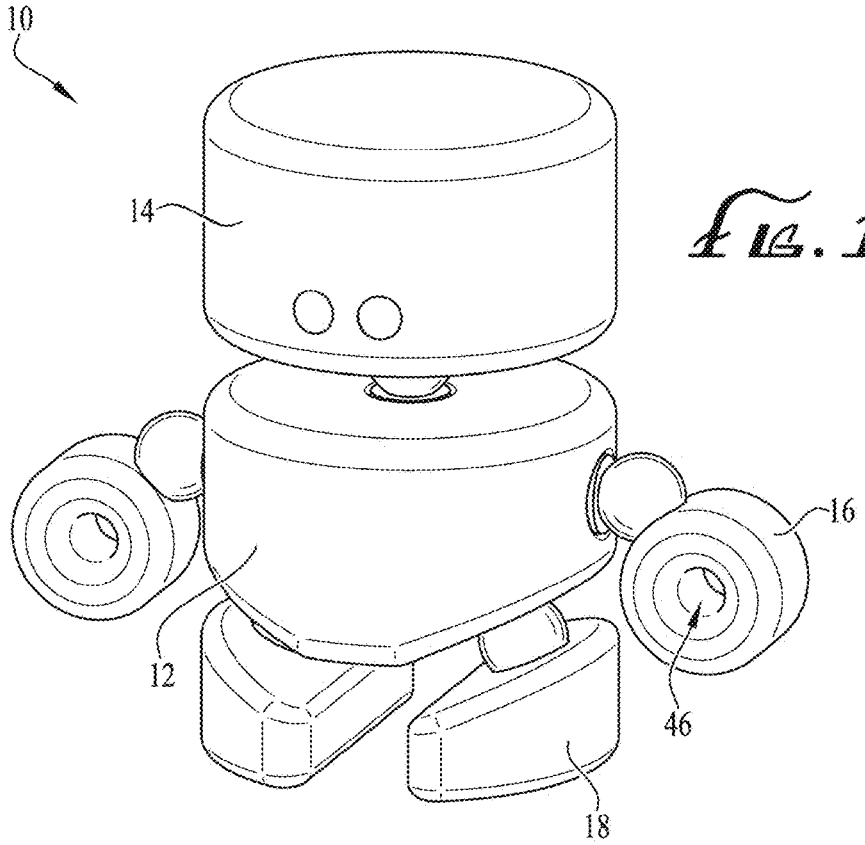
FIGS. 1 and 2 are views of a customizable figurine having magnetically attachable components in accordance with one embodiment.
Figure 2:
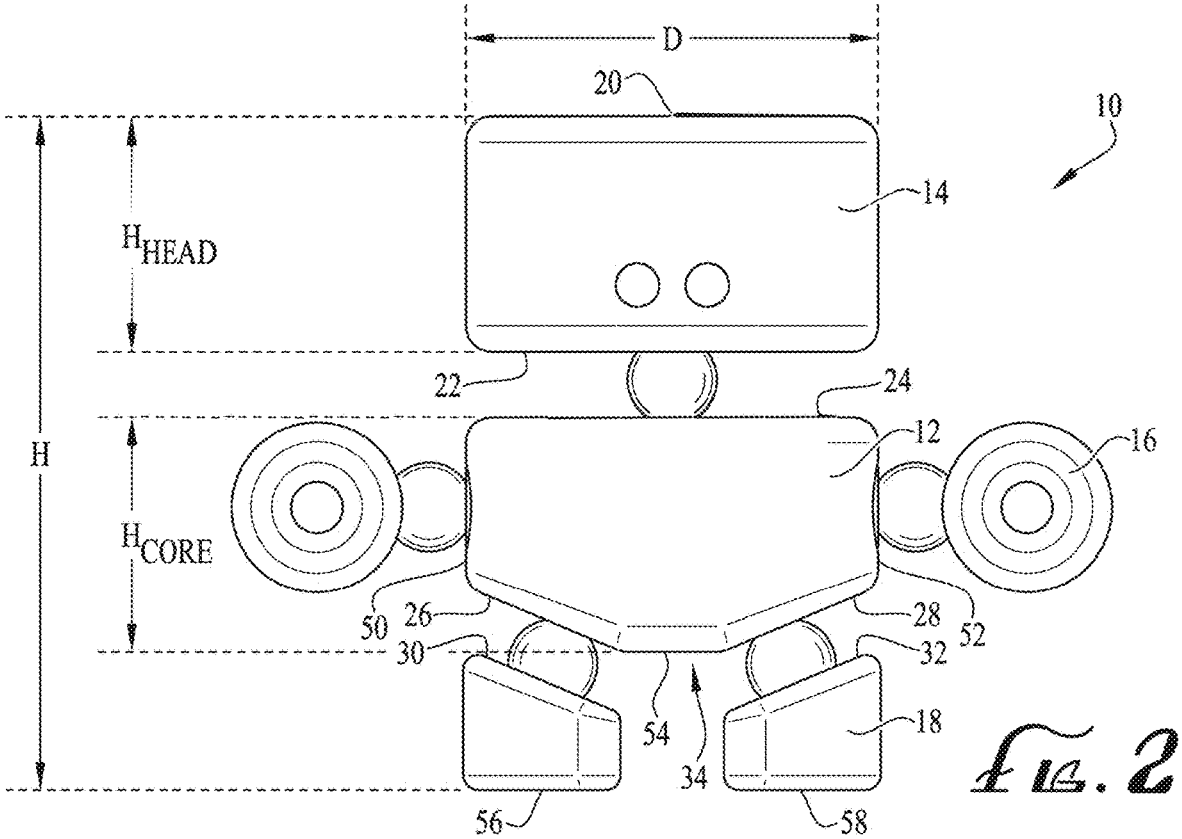

FIGS. 1 and 2 illustrate a figurine 10 including a variety of user-customizable components for creating a unique design. In one embodiment, the figurine 10 includes a core or base 12, a head 14, a pair of hands 16, and a pair of feet 18, each of which are detachably securable to the core 12. Additional details regarding example means for attachment of the components are described in later passages with particular reference to FIGS. 3-5. With reference to FIGS. 1-2, the following section describes additional details of the figurine 10 and its components.

As illustrated in FIG. 1, the figurine 10 may resemble a generally humanoid shape with a head, torso, hands, and feet, where the figurine 10 has a generally cylindrical configuration (excluding the hands) when fully assembled. In some embodiments, the core 12, head 14, and feet 18 of the figurine 10 may be formed by cutting or dividing the overall elongated cylinder into the various body parts to achieve the overall cylindrical configuration. For example, with general reference to FIG. 2, the head 14 may include a substantially planar top surface 20 and a substantially planar bottom surface 22. Similarly, the core 12 (which generally represents the torso of the figurine 10) may include a substantially planar top surface 24 having a profile that matches or corresponds to that of the bottom surface 22 of the head 14, such that the respective surfaces 22, 24 sits flush against one another when the two components are brought together into contact.

It should be understood that the planar profiles of the surfaces 22, 24 are only one example configuration of the figurine 10. In other embodiments, the surfaces 22, 24 may not be substantially planar, but may take any one of a variety of suitable shapes, including curvatures and angled surfaces. Preferably, in such embodiments, the respective surfaces 22, 24 are designed such that their respective profiles match one another to allow for the surfaces 22, 24 to mate and sit flush against one another in a similar manner as described previously.

With reference to FIG. 2, the following describes additional features of the core 12. As illustrated in FIG. 2, the core 12 includes a top surface 24 and an opposite bottom surface 34, a first peripheral side surface 50 and an opposite second peripheral side surface 52. In some embodiments, the bottom surface 34 may be partially truncated to formed a pair of sloped side surfaces 26, 28, where the first side surface 26 extends from the first peripheral side surface 50 inwardly toward a midpoint of the bottom surface 34, and where the second side surface 28 similarly extends from the second peripheral side surface 52 inwardly toward a midpoint of the bottom surface 34. Preferably, the sloped side surfaces 26, 28 do not extend to the midpoint of the bottom surface 34 such that a planar, substantially central panel 54 extends between and separates the sloped side surfaces 26, 28.

The figurine 10 includes a pair of feet 18 with top surfaces 30, 32 and opposite bottom surfaces 56, 58, respectively. The top surfaces 30, 32 of the feet 18 are formed such that their respective top surfaces 30, 32 are sloped to match the sloped profile of the side surfaces 26, 28. Accordingly, the angle and direction of the sloped side surface 26, 28 is substantially equal to the angle and direction of the sloped top surfaces 30, 32 of the feet 18. In such embodiments, the top surfaces 30, 32 of the feet 18 sit flush against the corresponding sloped side surfaces 26, 28 of the core 12 when the two components are brought together into contact. Preferably, the bottom surfaces 56, 58 of the feet 18 are substantially planar to support the figurine 10 in a standing pose.

In other embodiments, the bottom surface 34 of the core 12 may not be truncated and may instead be substantially planar, similar to the bottom surface 22 of the head 14. In such embodiments, the top surfaces of the feet 18 may be designed to have a matching planar profile to maintain the overall aesthetic of the figurine 10 and its generally cylindrical shape.

As illustrated in FIG. 2, the figurine 10 includes a pair of hands 16 extending along the sides of the core 12. In one embodiment, a first hand 16 is coupled to the figurine 10 along the first peripheral side surface 50 of the core 12, and a second hand 16 is coupled to the figurine 10 along the second peripheral side surface 52. Additional features relating to movement and configuration of the hands 16 is further described in detail below with reference to FIGS. 3-5.

With particular reference to FIG. 2, the figurine 10 may have a generally elongated cylindrical overall shape as noted previously with a height dimension, H, being greater than a diameter dimension, D, as measured across the widest portion of the figurine 10. In some embodiments, the core 12 and head 14 may be substantially similar in dimensions, such that the height of the head, $H_{head}$, (as measured from the top surface 20 to the bottom surface 22) is substantially equal to the height of the core, $H_{core}$ (as measured from the top surface 24 to the bottom surface 34). In such embodiments, the diameter dimension for the core 12 and head 14 is the same as the diameter, D, of the figurine 10.

It should be understood that while the above description is made in reference to the figurine 10 having a generally cylindrical configuration as illustrated in FIGS. 1 and 2, the same concept of forming the figurine components from the overall shape of the figurine may be applied to other shapes as well, such as a pyramid, prism, or sphere. In these alternate configurations, the head, core, and feet may be similarly cut from the overall pyramid, prism, or sphere so that the respective components have matching profiles as described above.

The core 12, head 14, hands 16, and feet 18 of the figurine 10 may be formed from any suitable material. Preferably, the material is selected from a suitable set of materials that readily accept paint or other decoration to provide opportunities for user-customization. For example, in one embodiment, the components may be formed from a vinyl, resin, plastic, or other suitable material that can be painted with any pattern as desired. In other embodiments, the components may be formed from a plastic or other suitable material that may accept an adhesive such as for adding glitter, confetti, or other materials that can be adhered to the components of the figurine 10. While in some embodiments it may be preferred that the components are user-customizable, in other embodiments, the core 12, head 14, hands 16, and a pair of feet 18 may come preformed and decorated, such as with sports colors/logos, uniforms (e.g., cop, firefighter, ninja, chef), or any other suitable decoration as desired.

Figure 3:
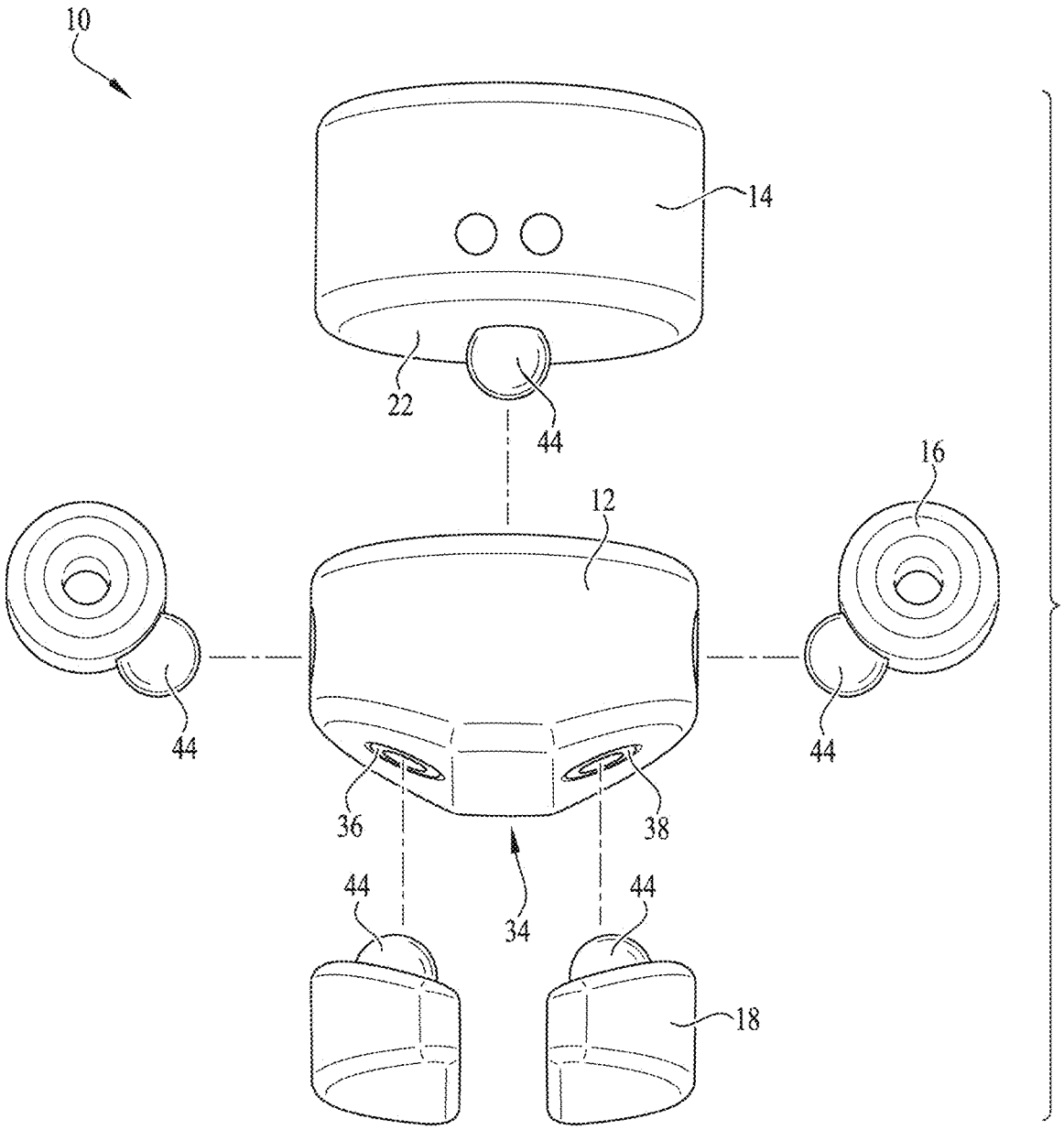
FIG. 3 is a partially exploded view of the figurine of FIG. 1 illustrating various components in a disassembled configuration in accordance with one embodiment.
Figure 4:
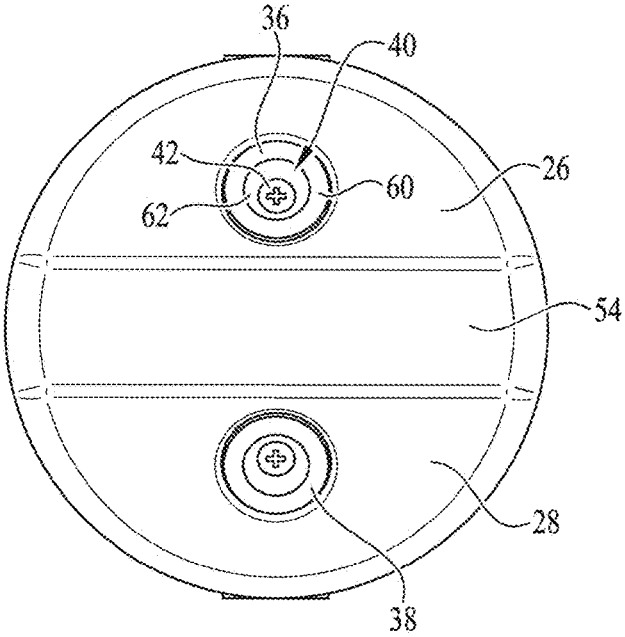
FIG. 4 is an enlarged view of a core component of the figurine of FIG. 1 illustrating a plurality of joints for coupling the attachable components to the core component in accordance with one embodiment.
Figure 5:
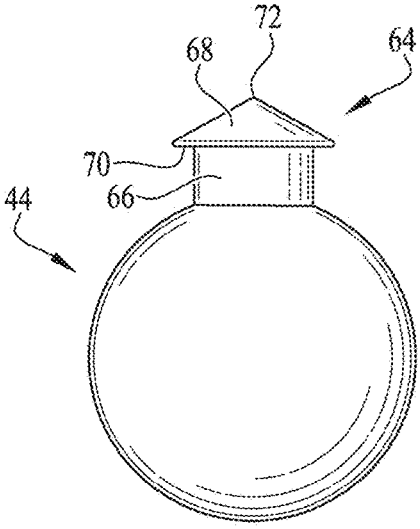
FIG. 5 illustrates a ball joint of the figure of FIG. 1 in accordance with one embodiment.

With collective reference to FIGS. 3-5, the following describes additional details of an example means for coupling and decoupling the various customizable components (e.g., head 14, hands 16, feet 18) from the core 12 in accordance with one embodiment. With general reference to FIGS. 3-5, the core 12 includes a plurality of magnetic socket joints coupled thereto, each socket joint configured to receive a magnetic ball for attaching a component of the figurine 10. For simplicity and to avoid repetition, the following description will focus on details of the magnetic socket joints 36, 38 as best illustrated in FIG. 4 with the understanding that the same description and features also apply to each of the various other socket joints incorporated into the core 12.

With reference to FIGS. 3 and 4, the core 12 includes a first socket joints 36 and a second socket joint 38 coupled along the bottom surface 34 of the core 12. In one embodiment, the first socket joint 36 may be positioned along the sloped side surface 26 and the second socket joint 38 may be positioned along the sloped side surface 28. The following describes features of the socket joints with particular reference to socket joint 36 to avoid repetition. It should be understood that the same description applies equally to the socket joint 38. With reference to FIG. 4, the socket joint 36 include a substantially planar top surface 60 and a cup 40 recessed downwardly from the top surface 60. The cup 40 includes curved side walls 62 having a curvature profile designed to match the corresponding curvature of a magnetic ball 44 (see FIG. 3) attached to each of the attachable components as further described in detail below. The socket joint 36 further includes an opening (not shown) formed along the bottom of the curved side walls 62, the opening designed to receive a fastener 42 (e.g., a screw or other suitable means) for coupling the socket joint 36 to the core 12. In other embodiments, the socket joint 36 may instead be press fit, adhered, or otherwise incorporated into the core 12 such that a fastener 42 (and related opening on the socket joint 36) is not needed. In some embodiments, the socket joints 36, 38 are each formed of a magnetic material and designed to interact magnetically with the magnetic ball 44 as further described in detail below. In other embodiments, the socket joints 36, 38 may incorporate magnets capable of magnetic interaction with the magnetic ball 44.

FIG. 5 illustrates an example embodiment of a magnetic ball 44 that operates as a ball joint for moving and rotating the head 14, the hands 16, and the feet 18 relative to the core 12. The magnetic ball 44 also facilitates coupling and decoupling of the head 14, hands 16, and feet 18 from the core 12 to customize the figurine 10 as desired. In some embodiments, the magnetic ball 44 may be plated with any suitable metal, such as nickel or chrome, to provide a different friction feel for moving and rotating the components, as desired. The following provides additional details relating to the magnetic ball 44 followed by details relating to an example assembly and operation of the figurine 10.

With reference to FIG. 5, the magnetic ball 44 includes a generally round curvature having a profile matching that of the cup 40 of the socket joints 36, 38. The ball 44 formed of a metal or other suitable material with ferromagnetic properties such that it is magnetically attracted to the socket joints 36, 38. The ball 44 includes a barb 64 extending from the ball 44. In some embodiments, the barb 64 may include a neck 66 having a base that extends outwardly from the ball 44, and a crown or head 68 positioned on the neck 66. In some embodiments, the crown 68 may have a generally conical configuration with a bottom surface 70 having a width larger than the corresponding width of the neck 66, where the crown 68 gradually tapers from the bottom surface 70 toward an apex 72. The conical configuration of the crown 58 may help facilitate the process of coupling the ball 44 to the components of the figurine 10 as further described below.

The following provides an example assembly process for attaching the magnetic ball 44 to the components (e.g., head 14, hands 16, feet 18) of the figurine 10. In one example embodiment, the barb 64 is inserted through a narrow slit or opening (not shown) formed on the components, such as the head 14, during the molding process. In some embodiments, the head 14 may need to be exposed to heat to create sufficient pliability and flexibility in the head 14 to allow the barb 64 to pierce through. As the head 14 cools down and dries, the material sets around the barb 64 to retain the ball 44 firmly in position against the head 14. The same process may be repeated to position the balls 44 against the remaining components.

In other embodiments, the ball 44 may not include a barb feature, and the ball 44 may instead be attached to the components using other suitable means. For example, in other embodiments, the balls 44 may be press-fit, coupled via mechanical fasteners (e.g., screws, pins, etc.), adhered, or otherwise attached to the components.

The following provides an example assembly process for coupling and decoupling the components of the figurine 10. With particular reference to FIG. 3, once the respective ball 44 is coupled to each of the head 14, the hands 16, and the feet 18, the corresponding limb or component is moved toward anyone of the socket joints 36, 38 on the core 12 until the ball 44 is attracted to and magnetically couples with the corresponding socket joint 36, 38. For example, one of the feet 18 may be magnetically attached to the socket joint 36, and the other of the feet 18 may be magnetically attached to the socket joint 38 to form a standing support structure for the figurine 10. Similarly, the hands 16 and head 14 may be attached to corresponding socket joints (not shown) to fully assemble the figurine 10 as illustrated in FIG. 1.

When the figurine 10 is fully assembled, the magnetic force of the socket joints 36, 38 is sufficient such that the figurine 10 may be moved and lifted as a unitary mass, with the components remaining magnetically coupled to the core 12 and capable of supporting the weight of the attached components without unwanted decoupling. Moreover, the spherical ball 44 is designed to rotated within the socket joint 36, 38 such that the limbs may be rotated and moved relative to the core 12 as desired. This design allows for the figurine 10 to be arranged in any one of numerous stances and postures. Once attached, the feet 18 (or any other component) may be decoupled from the core 12 my simply pulling the feet 18 (or other component) away from the core 12 with sufficient force to overcome the magnetic force from the socket joints 36, 38.

Figure 6:
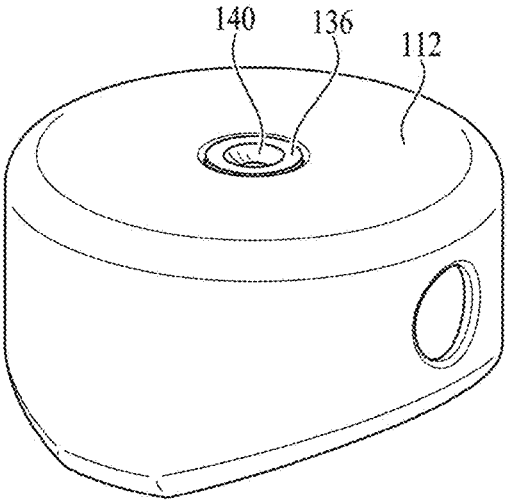
FIG. 6 is an enlarged view of a core component in accordance with another embodiment.
Figure 7:
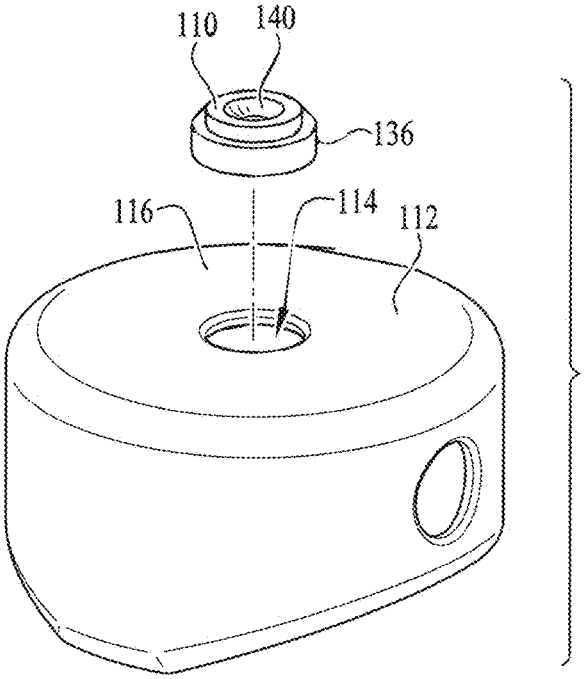
FIG. 7 is a partially exploded view of the core component of FIG. 6 illustrating details of a magnet in accordance with one embodiment.

FIGS. 6 and 7 collectively illustrate another embodiment of a core 112 that may be used with the figurine 10. The core 112 may be made from the same materials and includes the same or similar characteristics/functionalities as the core 12 described previously with reference to FIGS. 1-5. Accordingly, such features are not further described in detail below to avoid obscuring more pertinent aspects of the embodiment. Instead, the following focuses on the differences between the embodiments.

With reference to FIGS. 6 and 7, the core 112 includes socket joints 136 that may be attached in a different manner to the core 112 than the socket joints 36, 38 are attached to the core 12. With particular reference to FIG. 7, the socket joints 136 are designed to be snap fit into core 112. For example, the socket joints 136 may include a lip portion 110 design to fit and engage within an opening 114 formed on a surface 116 of the core 112 to accommodate the socket joints 136. When the socket joints 136 are snap fitted into the core 112, the magnetic socket joints 136 may sit flush against the surface 116 of the core 112 as illustrated in FIG. 6. Similar to the embodiment described previously, the socket joints 136 include a cup 140 recessed inwardly and designed for receiving the balls 44 attached to the various limb components. While not discussed in further detail, it should be understood that the remaining magnetic joints on the core 112 may be applied in a similar snap-fit fashion.

While the foregoing embodiments illustrate a design where the joints 36, 38 are coupled to the core 12, and the balls 44 are coupled to the head 14, hands 16, and feet 18, it should be understood that in other embodiments, the arrangement of balls 44 and joints 36, 38 may instead be reversed such that the core 12 may include a variety of balls attached thereto and the head 14, hands 16, and feet 18 may include a variety of magnetic joints attached thereto. In addition, it should be understood that the specific arrangement and configuration of the head and limbs relative to the core 12 may be altered according to the specific desires of the user such that the head and/or limbs may be attached to any joint in any desired configuration.

As illustrated and described, the figurine 10 includes a single ball 44 to attach each component to the core 12. In other embodiments, the figurine 10 may include any number of balls 44 for each of the head and limbs to lengthen the distance from the core 12 to the head and limbs and to provide for additional degrees of articulation. For example, in one embodiment, the head 14, hands 16, and feet 18 may each include three total balls 44, where one is attached to the component, one is magnetically coupled to the socket joint 36 on the core 12, and one is positioned in between the two balls. The balls may be designed and arranged such that they are each rotatable relative to one another to accommodate further articulation for each of the limbs. In other embodiments, more or fewer balls may be used as desired.

Figure 8:
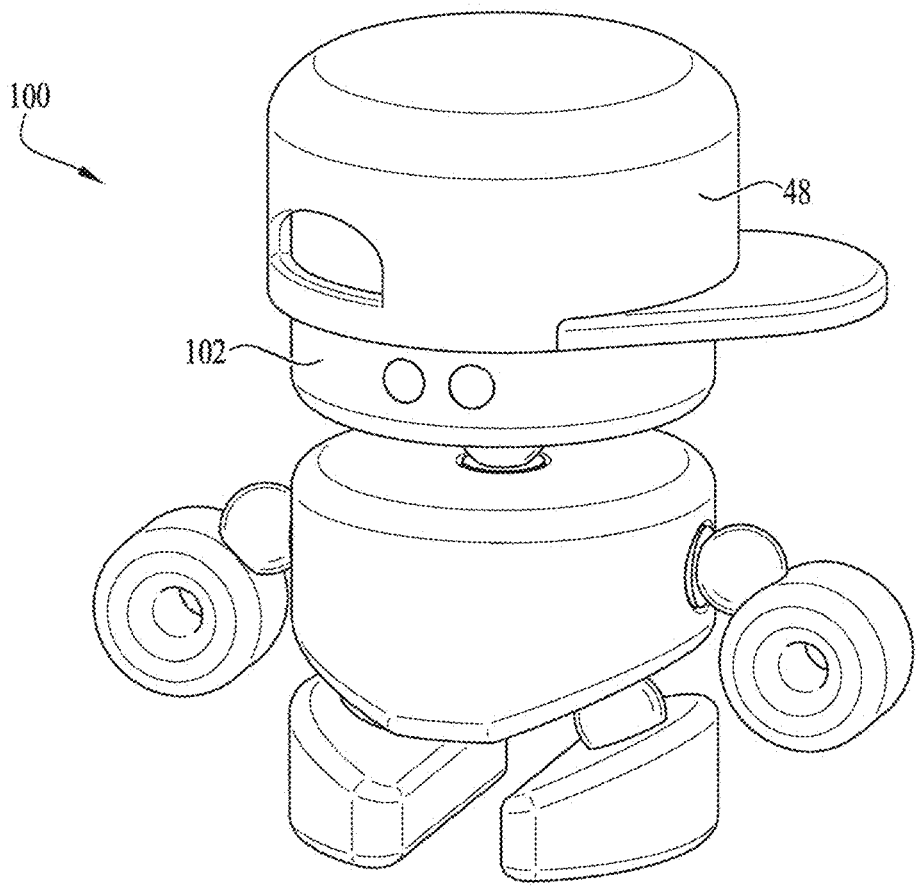
FIG. 8 is a view of another embodiment of a customizable figurine illustrating an example accessory for use with the figurine.
Figure 9:
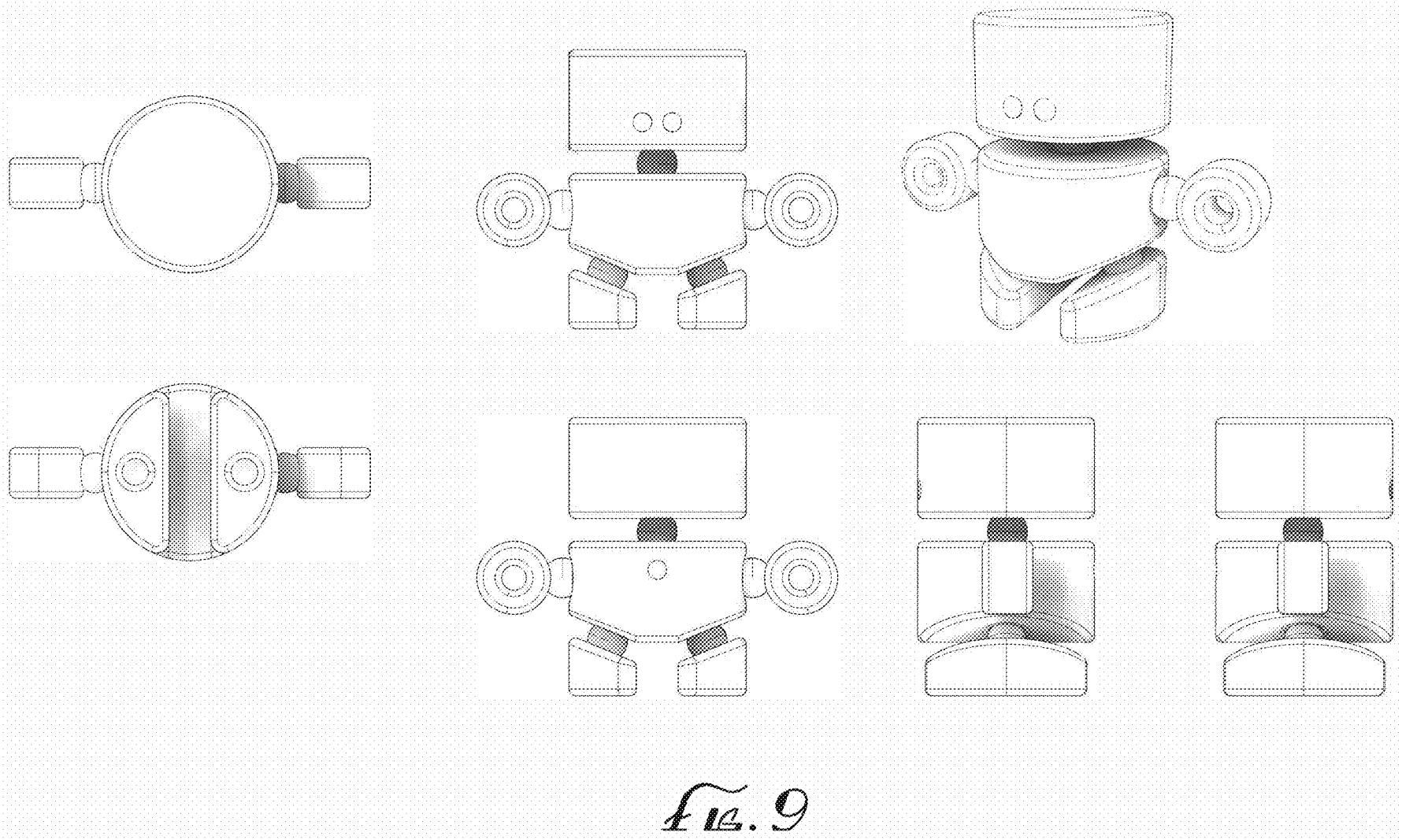
FIGS. 9-21 illustrate additional embodiments of the customizable figurine of FIG. 1.
Figure 10:
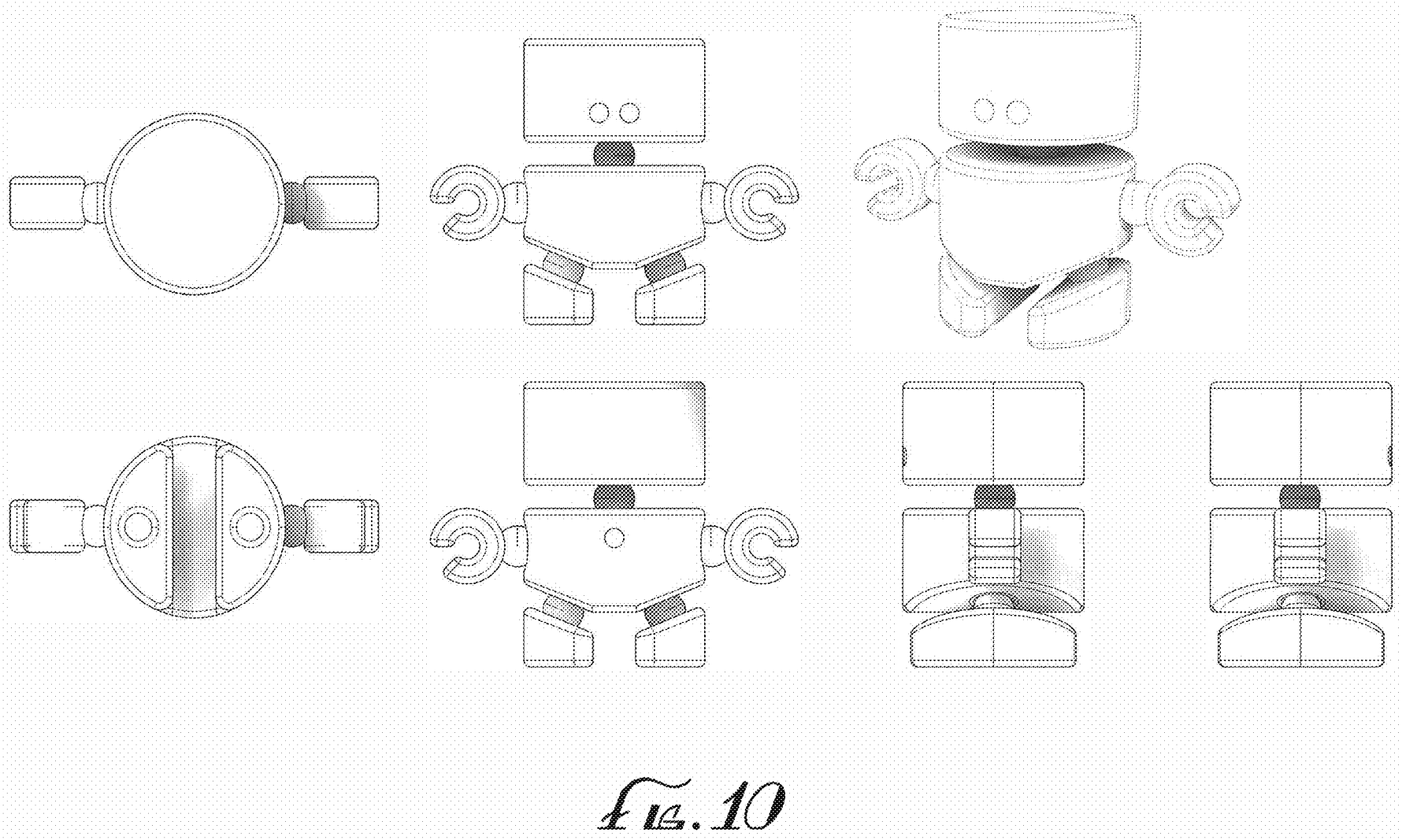
Figure 11:
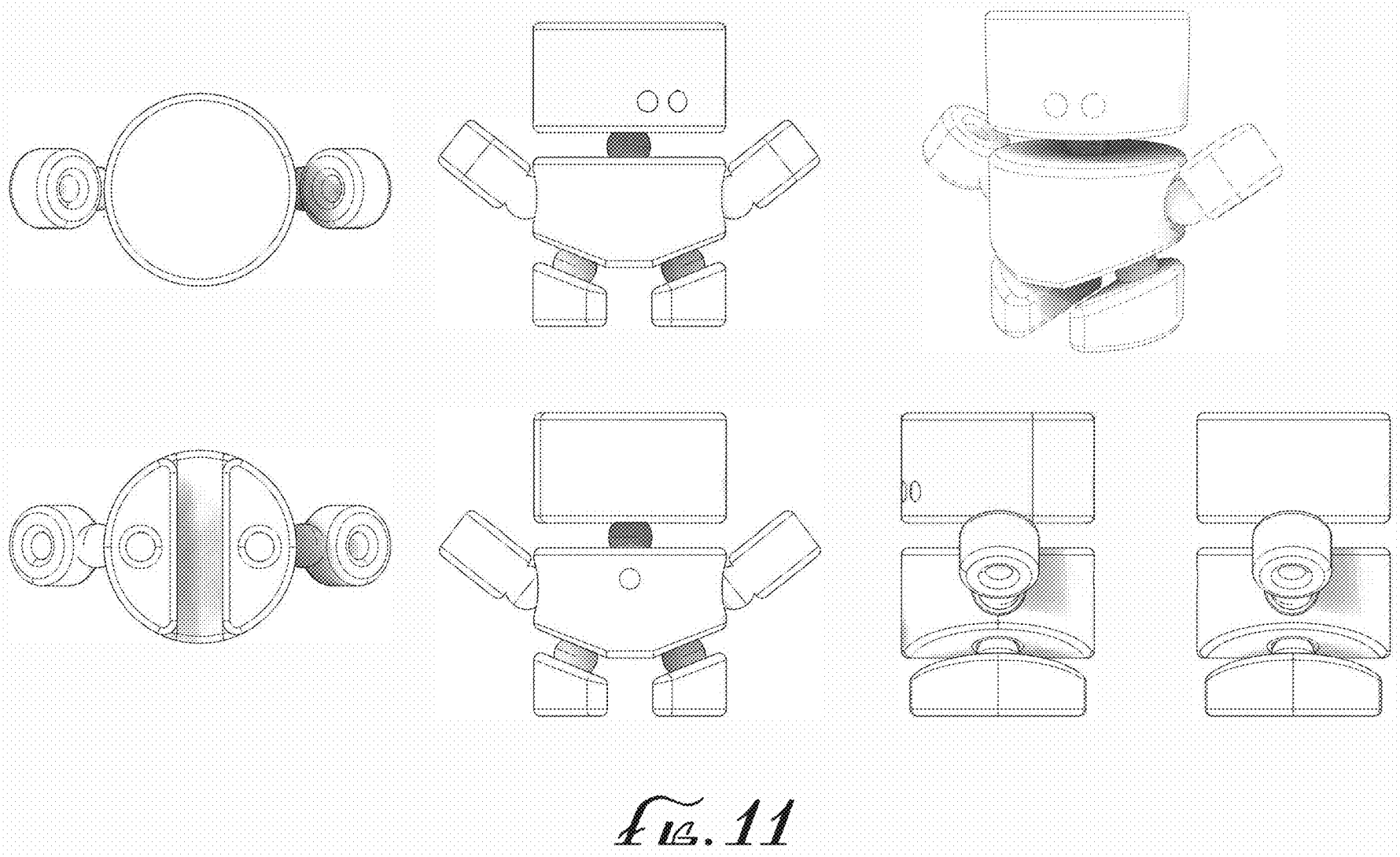
Figure 12:
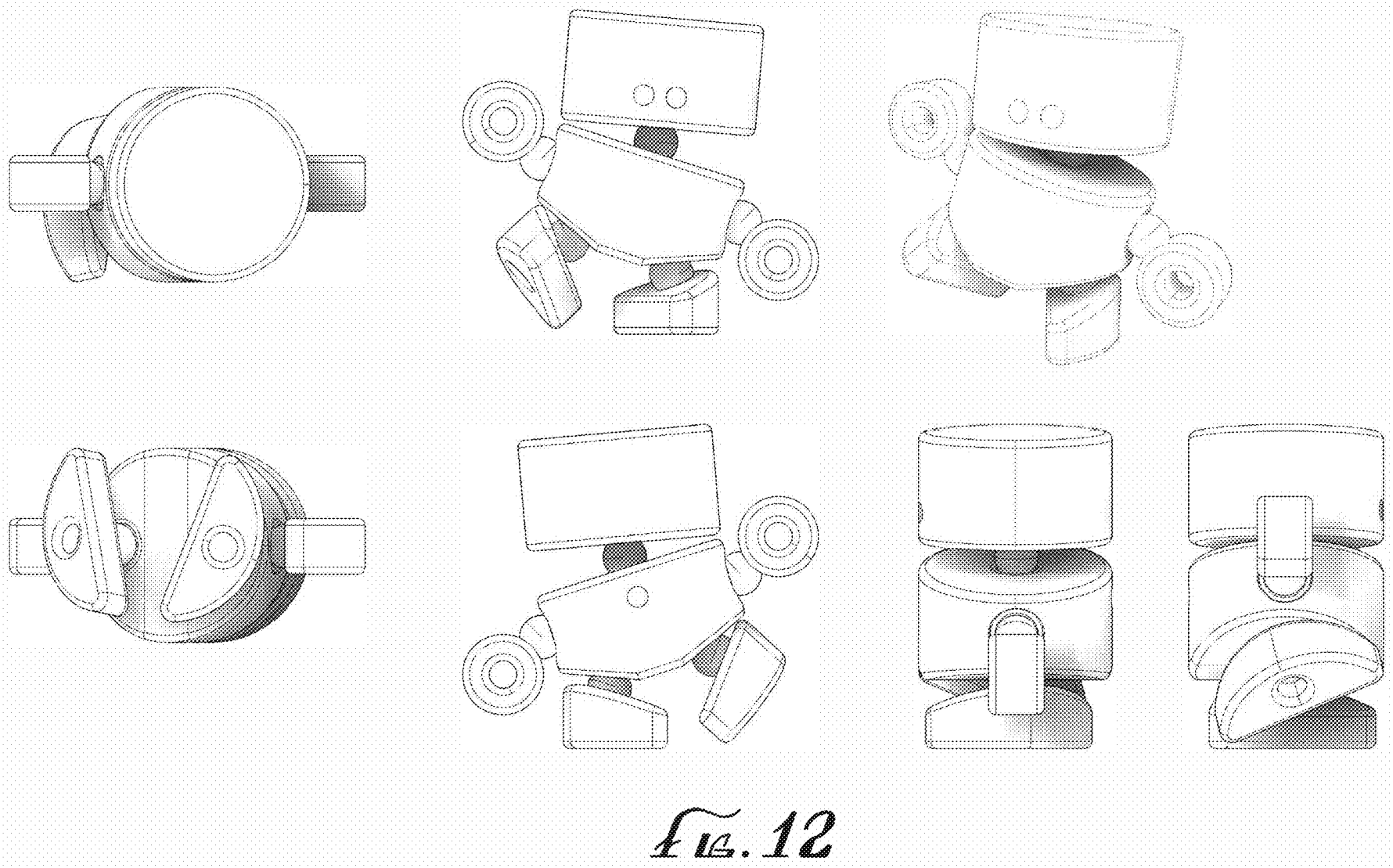
Figure 13:
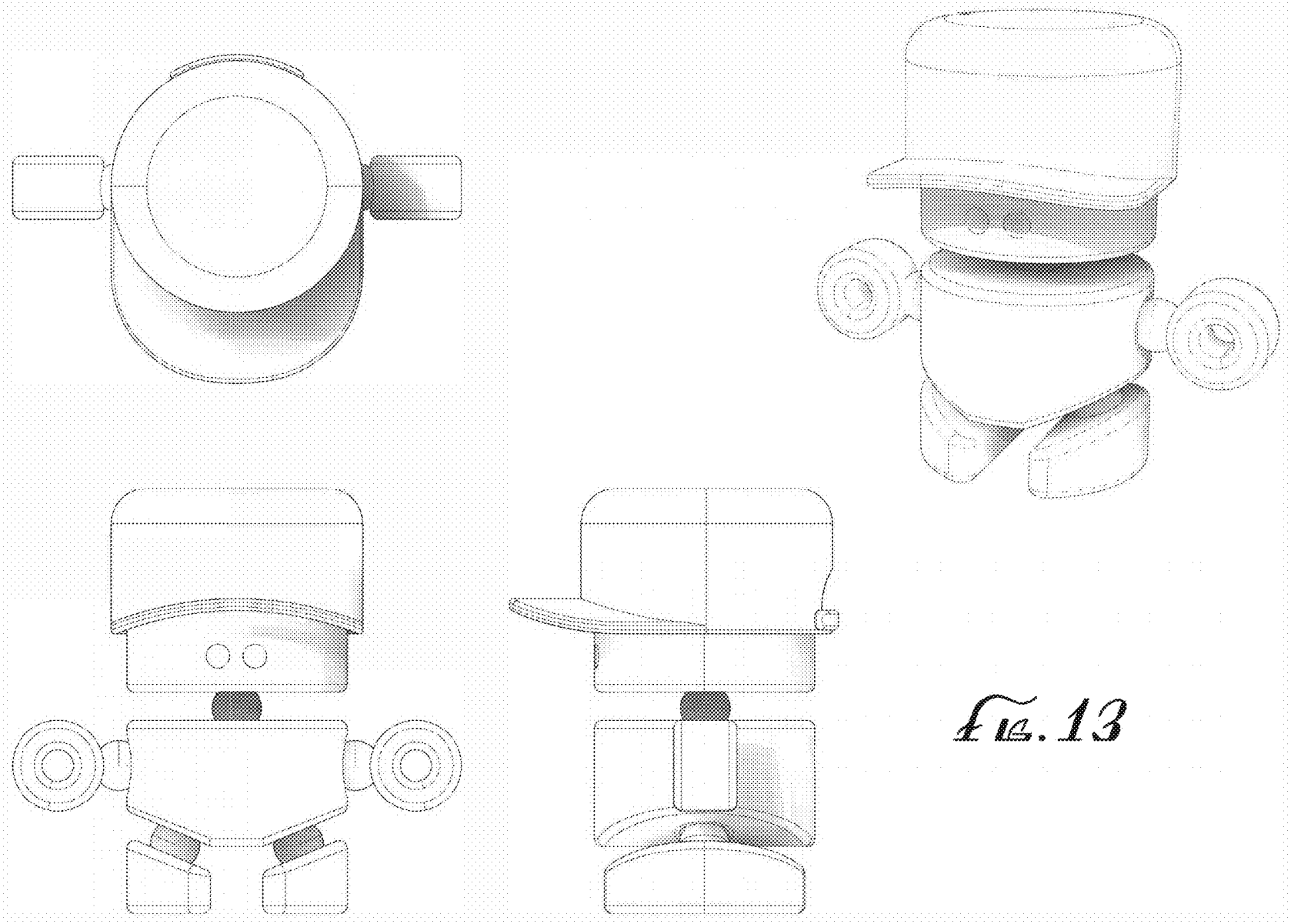
Figure 14:
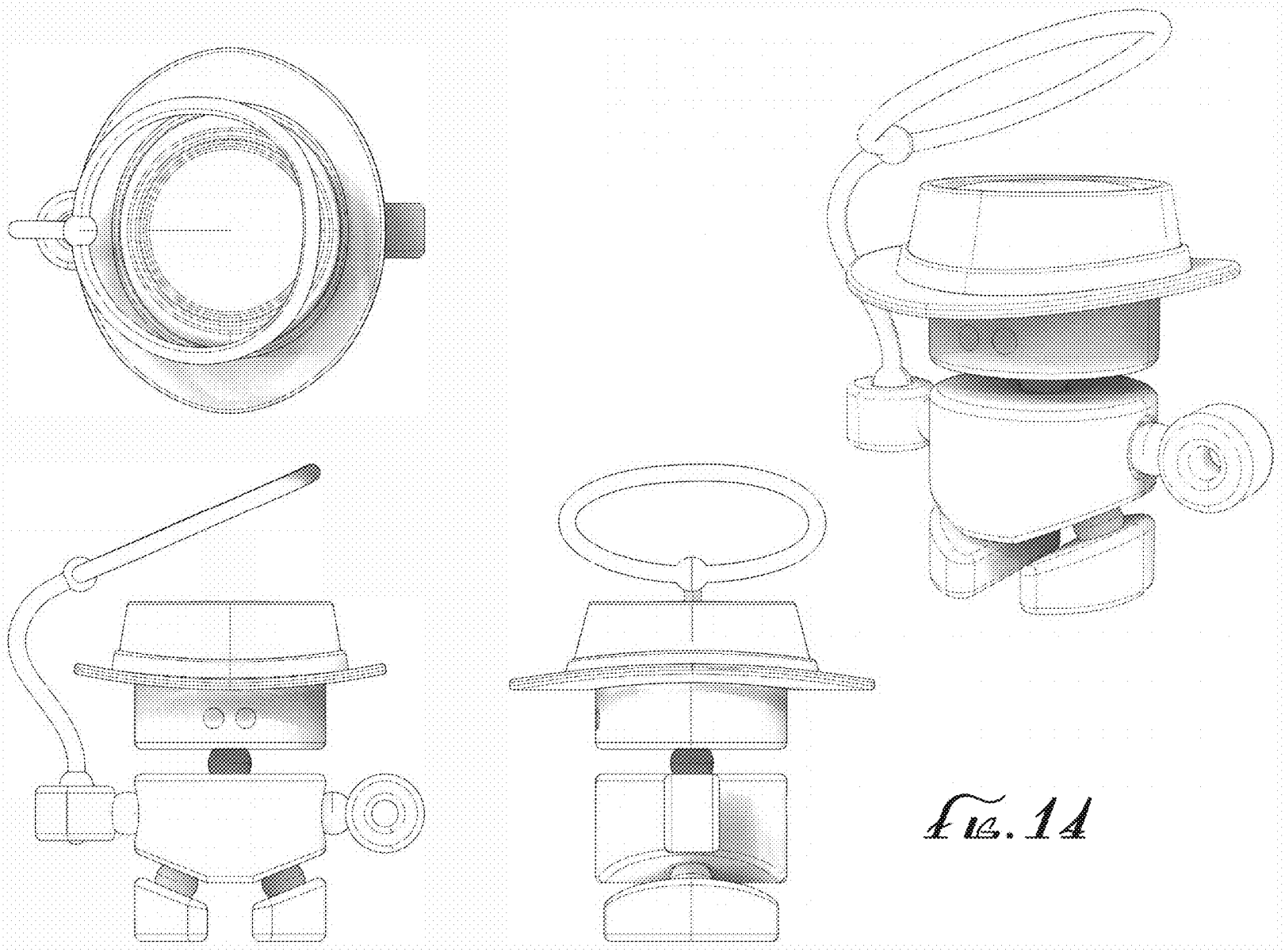
Figure 15:
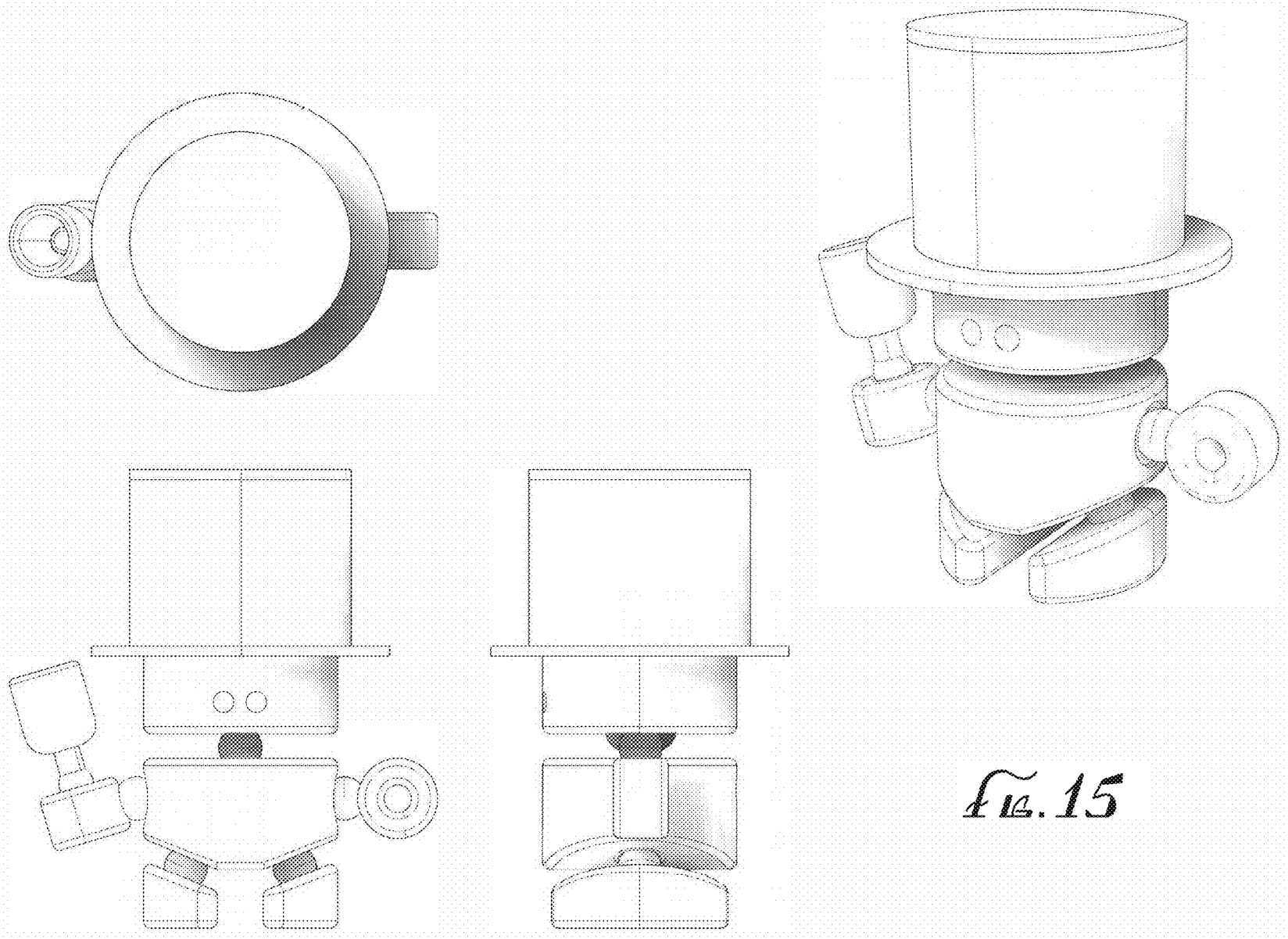
Figure 16:
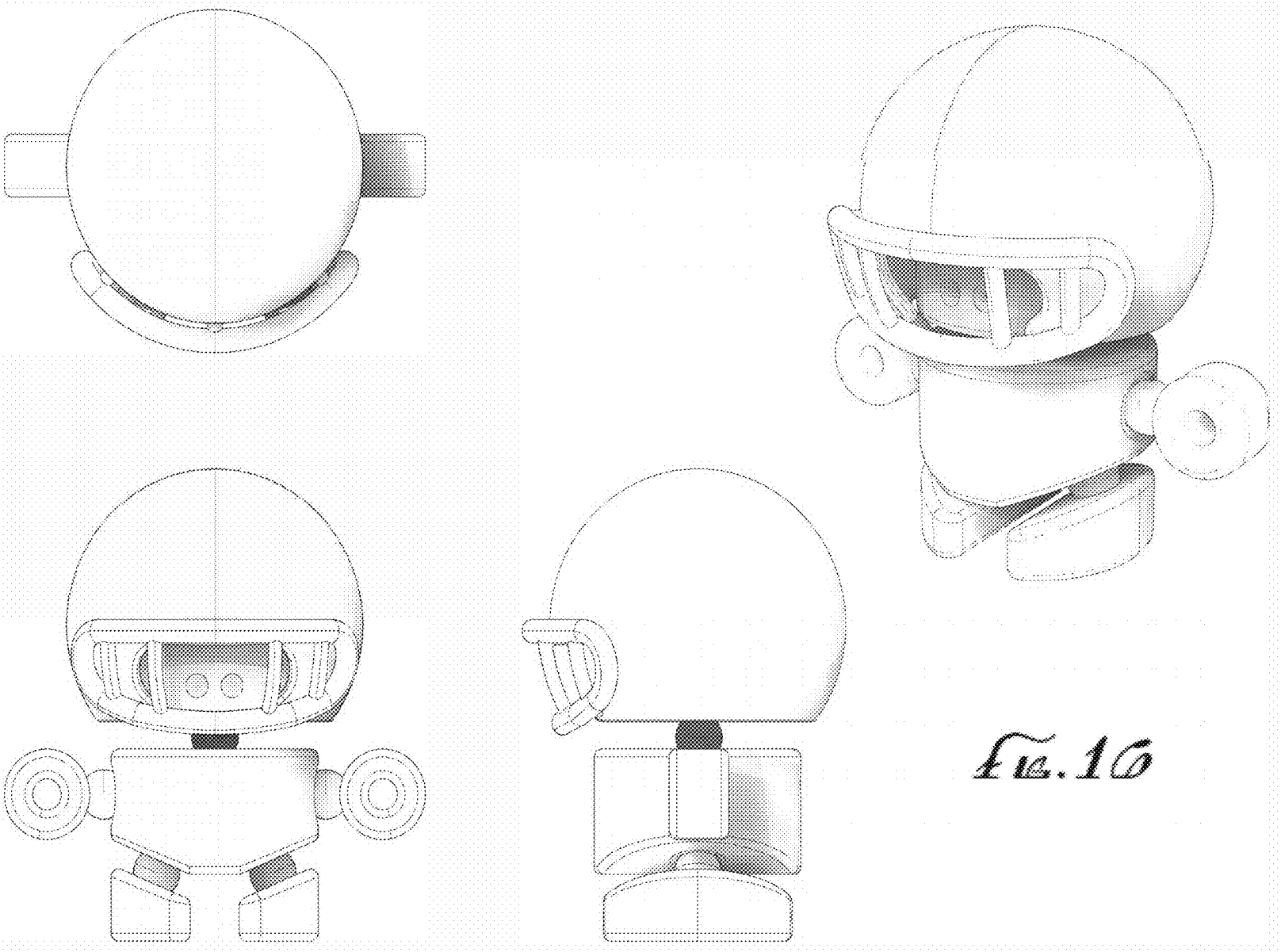
Figure 17:
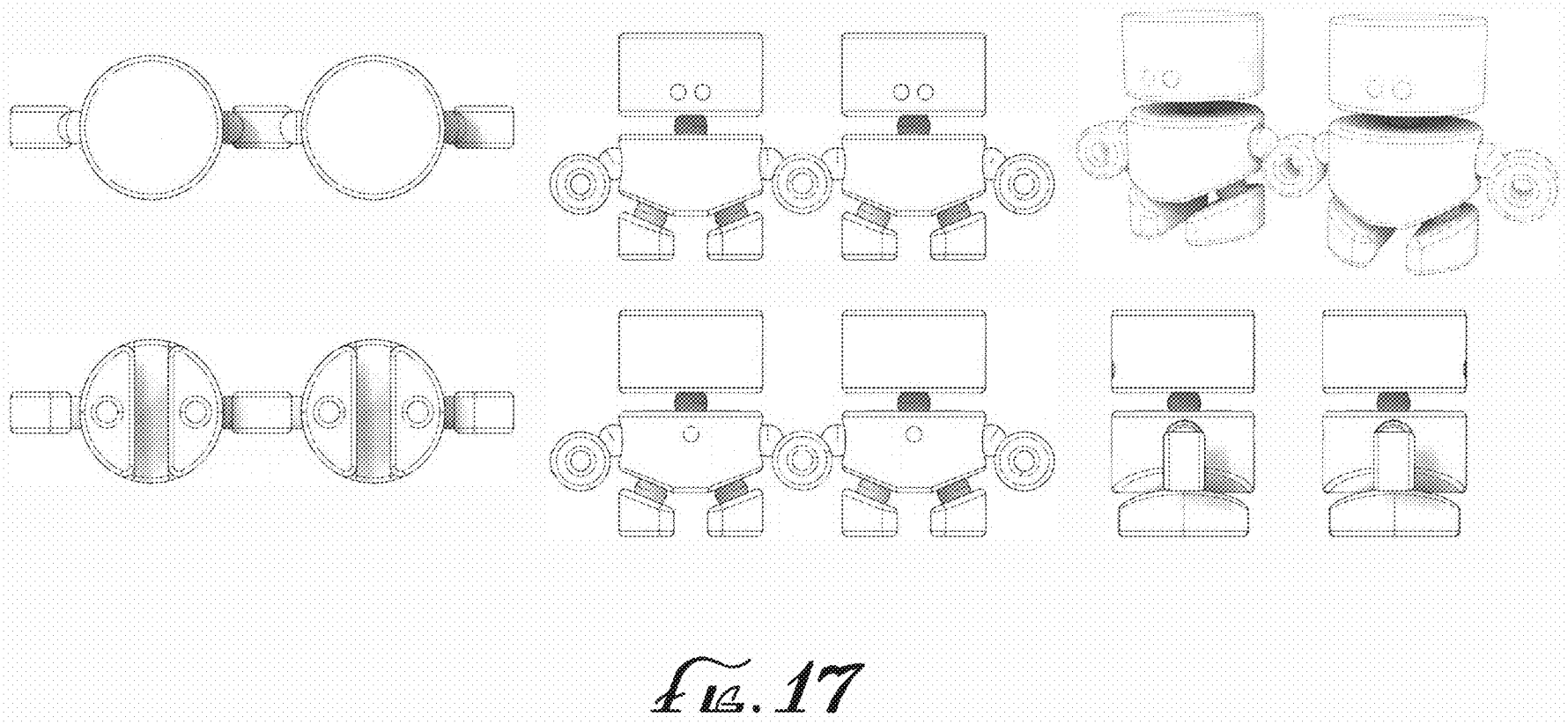
Figure 18:
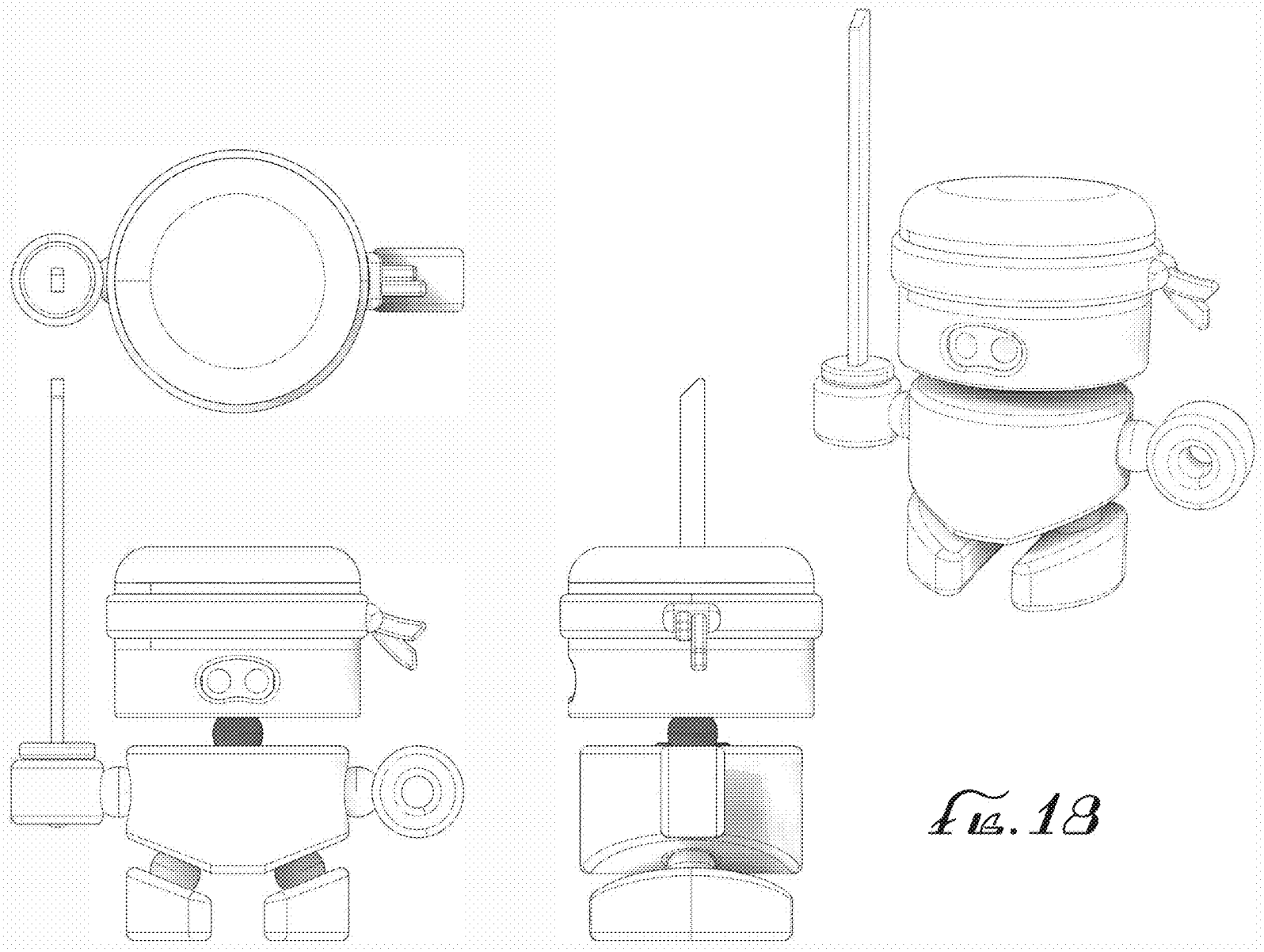
Figure 19:
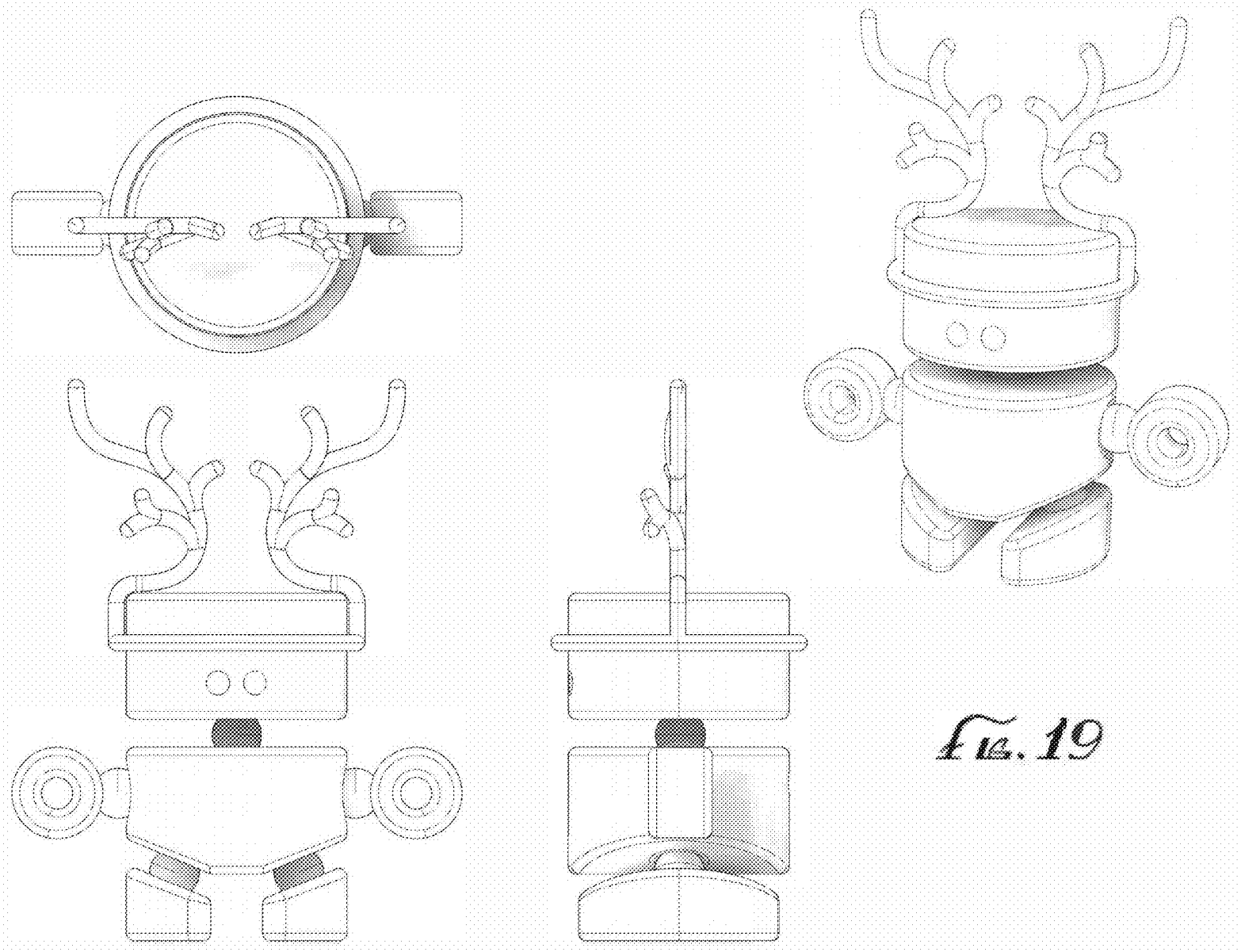
Figure 20:
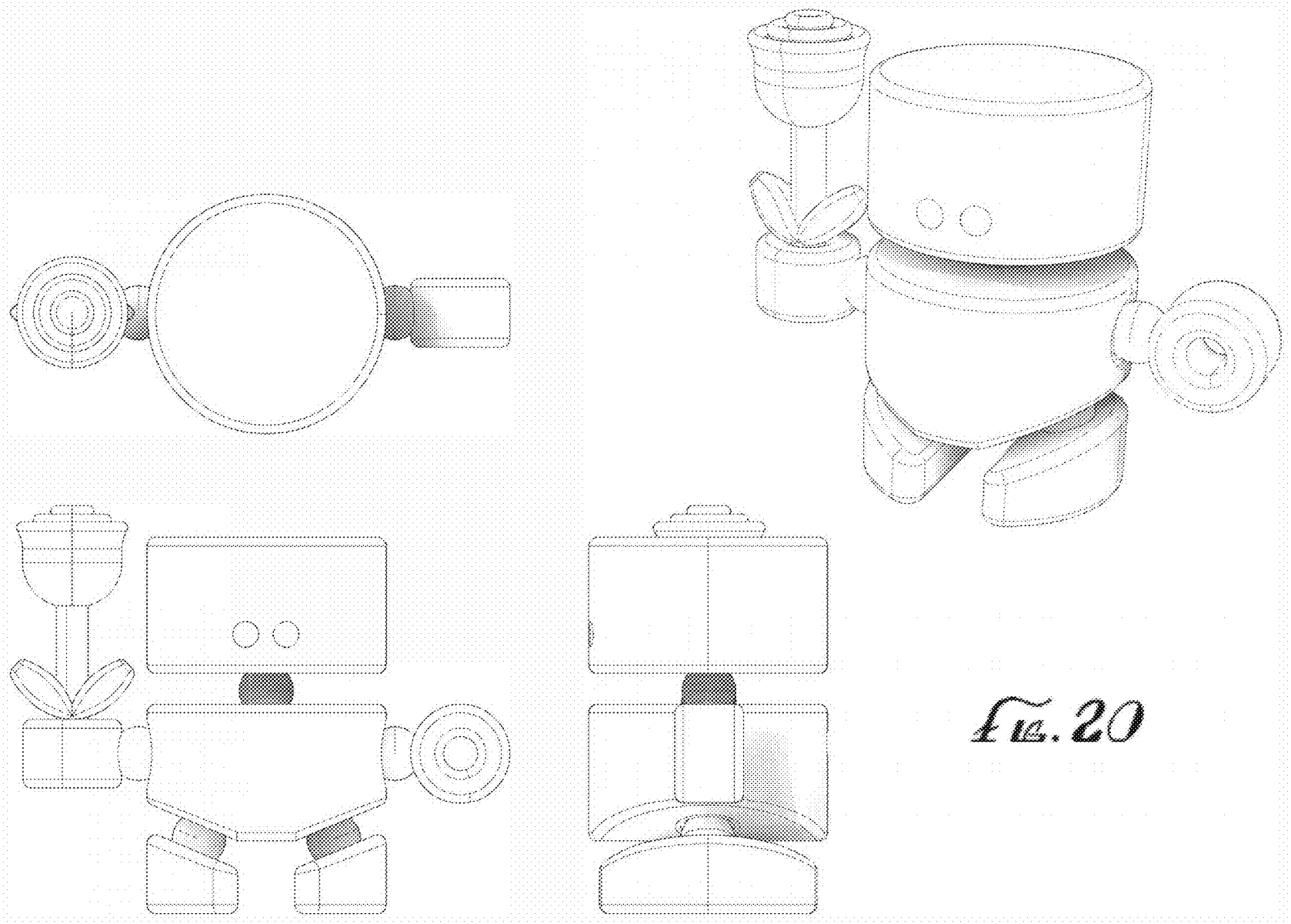
Figure 21:
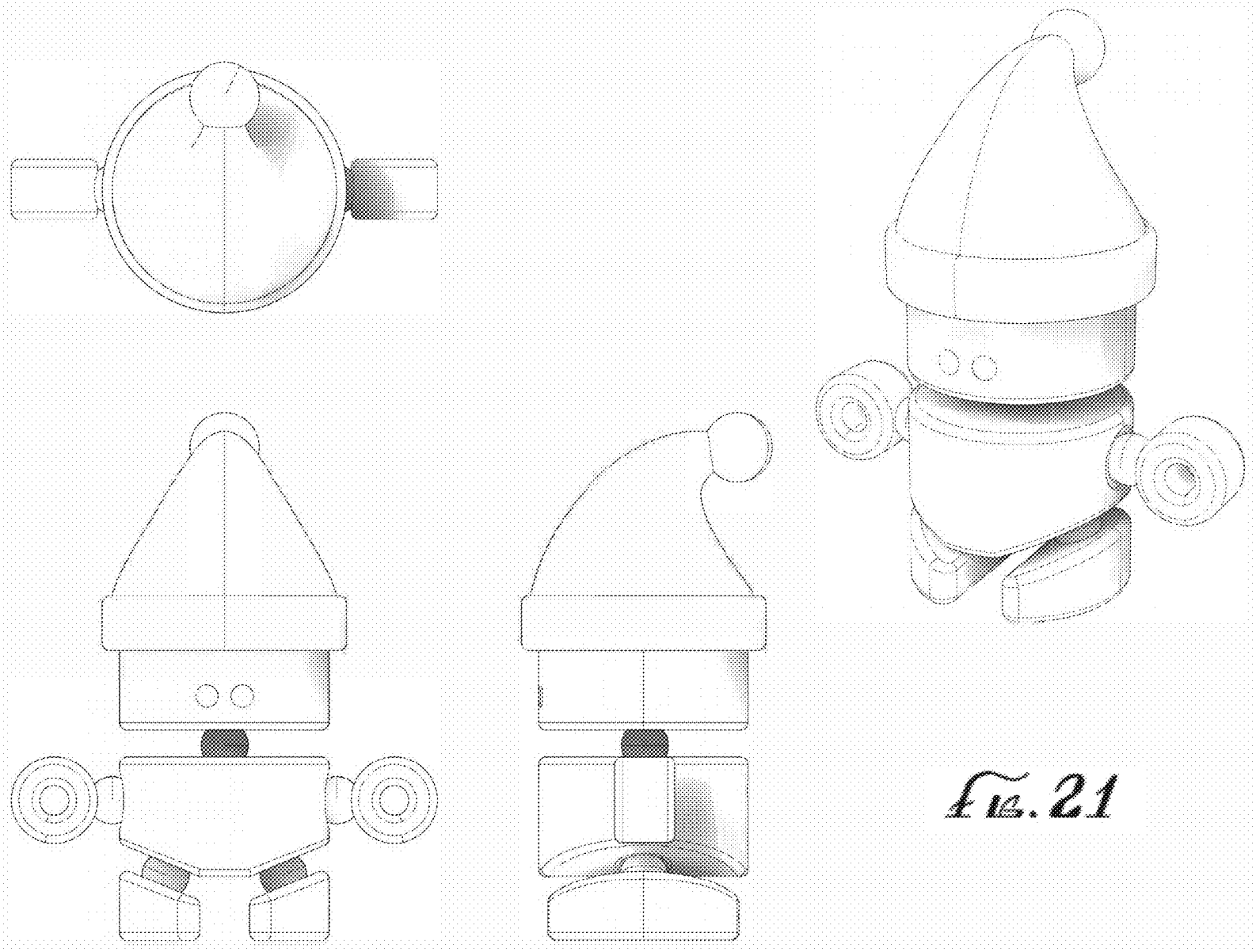

As mentioned previously, the figurine is designed to be user-customizable as desired. For example, in some embodiments, the hands 16 may each include a full bore 46 (see FIG. 1) extending through the center of the hands 16 or a partial bore (not shown) extending partway through the center of the hands 16 from a top surface toward a bottom surface thereof. The full or partial bore 46 is configured to receive any one of a number of accessories (such as a flagpole, sword, knife, bat, lasso, or any other suitable object). Accessories may also be incorporated with any of the other components of the figurine. For example, FIG. 8 illustrates another embodiment of a figurine 100 having a head 102 designed to receive a cap or hat 48 as illustrated in FIG. 8. The cap 48 may be formed of the same or similar material as the other components of the figurine 100 such that the cap 48 may also be painted, decorated, or otherwise stylized as desired. As noted previously, the figurine 10, 100 may take any one of a number of forms or configurations, and may accommodate a number of accessories to alter its visual appearance. Some examples of other embodiments for the customizable figurine are illustrated in FIGS. 9-21.

It should be understood that many of the features and components illustrated and described in the embodiments of FIGS. 1-21 are for illustration purposes. Accordingly, one having ordinary skill in the art may rearrange the features and components described herein in any of the embodiments without departing from the principles of the disclosure. In addition, it is intended that subject matter disclosed in one portion herein can be combined with the subject matter of one or more of other portions herein as long as such combinations are not mutually exclusive or inoperable. In addition, many variations, enhancements and modifications of the concepts described herein are possible.

The terms and descriptions used above are set forth by way of illustration only and are not meant as limitations. Those skilled in the art will recognize that many variations can be made to the details of the above-described embodiments without departing from the underlying principles of the invention.

The invention claimed is:

1. A figurine comprising:

a core including a top surface and an opposite bottom surface;

a first core magnetic joint coupled to the core along the top surface thereof wherein the core further includes an opening extending through the top surface thereof and having a diameter, wherein the first core magnetic joint includes a bottom portion and a top portion, the bottom portion having an outer rim with a diameter larger than the diameter of the opening, such that the opening retains the outer rim of the bottom portion beneath the top surface of the core and the top portion extends through the opening when the first core magnetic joint is coupled to the core;

a second core magnetic joint and a third core magnetic joint each coupled to the core along the bottom surface thereof, the second and third magnetic joints offset from one another;

a head including a top surface and an opposite bottom surface; and a first head magnetic joint coupled to the bottom surface of the head, the first head magnetic joint magnetically interacting with the first core magnetic joint to couple the head to the core, wherein the first head magnetic joint and the first core magnetic joint cooperate with one another to facilitate movement of the head relative to the core, wherein the first head magnetic joint includes a rounded ball and a barb extending outwardly therefrom, the barb extending into the head through the bottom surface of the head and firmly retaining the rounded ball against the bottom surface of the head, the rounded ball separating the bottom surface of the head from the top surface of the core when the head is coupled to the core, wherein the first core magnetic joint comprises a recessed cup that receives the rounded ball when the head is couple to the core, the cup having curved side walls with a curvature profile that matches a corresponding curved surface of the rounded ball.

2. The figurine of claim 1, further comprising a first foot including a top surface and an opposite bottom surface, the top surface of the first foot including a first foot magnetic joint coupled thereto, the first foot magnetic joint magnetically interacting with the second core magnetic joint to couple the first foot to the core.

3. The figurine of claim 2, further comprising a second foot including a top surface and an opposite bottom surface, the top surface of the second foot including a second foot magnetic joint coupled thereto, the second foot magnetic joint magnetically interacting with the third core magnetic joint to couple the second foot to the core.

4. The figurine of claim 1, the core further comprising a fourth core magnetic joint coupled along a first peripheral side surface of the core, the figurine further comprising a first hand including a first hand magnetic joint coupled thereto, the first hand magnetic joint magnetically interacting with the fourth core magnetic joint to couple the first hand to the core.

5. The figurine of claim 1, the core further comprising a fifth core magnetic joint coupled along a second peripheral side surface of the core opposite the first peripheral side surface, the figurine further comprising a second hand including a second hand magnetic joint coupled thereto, the second hand magnetic joint magnetically interacting with the fifth core magnetic joint to couple the second hand to the core.

6. The figurine of claim 5, wherein the first and second hands each include an opening extending from a top surface toward a bottom surface thereof, and wherein the figurine further includes an accessory with a handle extending through the opening of one or both of the first and second hands.

7. The figurine of claim 6, wherein each of the openings of the first and second hands extends entirely through from the top surface through to the bottom surface thereof.

8. The figurine of claim 1, wherein the first core magnetic joint includes a cup with curved side walls recessed downwardly from a top surface thereof, and wherein the rounded ball has a curvature profile corresponding to the curved side walls of the cup such that the cup receives the ball therein and accommodates rotational movement of the head relative to the core.

9. The figurine of claim 8, wherein the barb further includes a neck extending from the rounded ball and a crown supported on the neck, and wherein the head includes an opening formed on the bottom surface thereof, the crown and neck of the rounded ball extending through the opening on the head to couple the rounded ball to the head.

10. The figurine of claim 1, wherein the bottom surface of the core includes a first angled surface extending from a first peripheral side of the core toward a midpoint of the bottom surface, and further includes a second angled surface extending from a second peripheral side of the core toward the midpoint of the bottom surface.

11. The figurine of claim 10, wherein the bottom surface further includes a substantially planar region extending between the first and second angled surfaces.

12. The figurine of claim 10, wherein the second core magnetic joint is coupled to the bottom surface along the first angled surface, and wherein the third core magnetic joint is coupled to the bottom surface along the second angled surface.

13. The figurine of claim 10, the figurine further comprising:

a first foot including a top surface and an opposite bottom surface, wherein the top surface of the first foot is angled at a slope equal to that of the first angled surface, the top surface of the first foot including a first foot magnetic joint coupled thereto, the first foot magnetic joint magnetically interacting with the second core magnetic joint to couple the first foot to the core; and a second foot including a top surface and an opposite bottom surface, wherein the top surface of the second foot is angled at a slope equal to that of the second angled surface, the top surface of the second foot including a second foot magnetic joint coupled thereto, the second foot magnetic joint magnetically interacting with the third core magnetic joint to couple the second foot to the core.

14. The figurine of claim 1, wherein the core further includes a second opening extending through the bottom surface of the core and having a diameter sized to retain the second core magnetic joint and a third opening extending through the bottom surface of the core and having a diameter sized to retain the third core magnetic joint, and wherein each of the second and third core magnetic joints includes a bottom portion having a diameter larger than the diameter of the corresponding second and third openings such that each of the second and third core magnetic joints is fitted and engaged in the respective second and third openings and thereby coupled to the core.

15. The figurine of claim 1, wherein the core further includes a second and third opening each extending through the bottom surface of the core, and wherein each of the second and third core magnetic joints includes an opening extending therethrough, the figurine further comprising:

a first fastener extending through the opening on the top surface and through the opening of the first core magnetic joint to couple the first core magnetic joint to the core;

a second fastener extending through the second opening on the bottom surface and through the opening of the second core magnetic joint to couple the second core magnetic joint to the core; and a third fastener extending through the third opening on the bottom surface and through the opening of the third core magnetic joint to couple the third core magnetic joint to the core.

16. The figurine of claim 1, the head further including an accessory removably coupled thereto.

17. A figurine comprising:

a core including a top surface and an opposite bottom surface;

a first core magnetic joint coupled to the core along the top surface thereof;

a second core magnetic joint and a third core magnetic joint each coupled to the core along the bottom surface thereof, the second and third magnetic joints offset from one another;

a head including a top surface and an opposite bottom surface; and a first head magnetic joint coupled to the bottom surface of the head, the first head magnetic joint magnetically interacting with the first core magnetic joint to couple the head to the core, wherein the first head magnetic joint and the first core magnetic joint cooperate with one another to facilitate movement of the head relative to the core, wherein the first core magnetic joint includes a rounded ball and a barb extending outwardly therefrom, the barb extending into the core through the top surface of the core and firmly retaining the rounded ball against the top surface of the core, the rounded ball separating the bottom surface of the head from the top surface of the core when the head is coupled to the core, wherein the first head magnetic joint comprises a cup recessed inwardly to receive the rounded ball, the cup having beveled side walls that match a corresponding surface portion of the rounded ball.

18. The figurine of claim 17, wherein the barb further includes a neck extending from the rounded ball and a crown supported on the neck, and wherein the core includes an opening formed on the top surface thereof, the crown and neck of the rounded ball extending through the opening on the core to couple the rounded ball to the core.

19. A method for making a figurine comprising:

providing a core having a surface, and a plurality of recesses in the surface wherein each of the plurality of recesses includes an opening in the surface and a pocket beneath the surface and inside the core, providing a plurality of core magnetic joints each including a bottom portion and a top portion, the bottom portion having an outer rim with a diameter larger than the opening, pressing one of the plurality of core magnetic joints through each opening into the corresponding pocket of the plurality of recesses, such that the bottom portion of each core magnetic joint is within the pocket and retained beneath the surface and inside the core and such that the top portion of each core magnetic joint extends through the opening, providing a head including a top surface and an opposite bottom surface with a head magnetic joint coupled to the bottom surface of the head, wherein a curved surface portion of the head magnetic joint matches a curved surface of the top portion of one of the plurality of core magnetic joints so that the corresponding curved surfaces abut when the head magnetic joint magnetically interacts with the one of the plurality of core magnetic joints to couple the head to the core, and coupling the head to the core.

* * * * *